US006169338B1

(12) United States Patent
Stoll et al.

(10) Patent No.: US 6,169,338 B1
(45) Date of Patent: Jan. 2, 2001

(54) COMPRESSED AIR SERVICING UNIT

(75) Inventors: Kurt Stoll, Esslingen; Michael Berner, Kirchheim, both of (DE)

(73) Assignee: Festo AG & Co., Esslingen (DE)

( * ) Notice: Under 35 U.S.C. 154(b), the term of this patent shall be extended for 0 days.

(21) Appl. No.: 09/173,221

(22) Filed: Oct. 15, 1998

(30) Foreign Application Priority Data

Oct. 18, 1997 (DE) ..... 197 46 179

(51) Int. Cl.[7] ..... F15B 19/00
(52) U.S. Cl. ..... 307/11; 307/42
(58) Field of Search ..... 307/11, 42

(56) References Cited

U.S. PATENT DOCUMENTS

| | | | |
|---|---|---|---|
| 2,706,995 | 4/1955 | May . | |
| 3,074,510 | 1/1963 | Thomas . | |
| 3,848,626 | 11/1974 | Smith et al. . | |
| 3,901,273 | 8/1975 | Brouwer et al. . | |
| 3,966,437 | 6/1976 | DeWolf et al. . | |
| 4,095,864 | 6/1978 | Hardin . | |
| 4,113,450 | 9/1978 | Goransson et al. . | |
| 4,231,768 | 11/1980 | Seibert et al. . | |
| 4,323,375 | 4/1982 | Chang . | |
| 4,456,168 | 6/1984 | Laakaniemi et al. . | |
| 4,458,841 | 7/1984 | Laakaniemi et al. . | |
| 4,469,128 | 9/1984 | Petrimaux et al. . | |
| 5,039,425 | 8/1991 | Caris et al. . | |
| 5,455,911 * | 10/1995 | Johansson | 395/864 |
| 5,457,594 | 10/1995 | Stoll et al. . | |
| 5,567,868 | 10/1996 | Craig et al. . | |

FOREIGN PATENT DOCUMENTS

| | | |
|---|---|---|
| 649 723 A5 | 6/1985 | (CH) . |
| 3428357 A1 | 2/1985 | (DE) . |
| WO/93/03822 | 3/1993 | (WO) . |
| WO 96/38671 | 12/1996 | (WO) . |

OTHER PUBLICATIONS

Färber, G., Bussysteme, 2. Aufl. München R. Oldenbourg Verlag, pp. 33–34 (1987), No Month Provided.
Peter Morlok, "Das ABC der dezentralen Druckluftaufbereitung", Olhydraulik und Pneumatik, No. 8, Mainz, DE(1997), No Month Provided.

* cited by examiner

*Primary Examiner*—Fritz Fleming
(74) *Attorney, Agent, or Firm*—Hoffmann & Baron, LLP

(57) ABSTRACT

A compressed air servicing unit is provided, which possesses a plurality of modules, such as pressure controllers, filters oilers or the like, adapted to be attached together in any desired order and having module housings, one of such modules being designed in the form of a monitoring unit for the other modules and being electrically connected with same. A bus line, connecting the modules together, of a bus system is provided and furthermore the monitoring module performing control functions as well is provided with a central unit of the bus system and the other modules are provided respectively with a bus subscriber station, sensors and/or actuators present in or on a module respectively, being connected with the associated bus subscriber station. This means that the modules may be arranged in practically any desired order and in an desired number without any problem occurring with electrical wiring or due to incorrect bus subscriber station connections.

16 Claims, 3 Drawing Sheets

COMPRESSED AIR SERVICING UNIT

BACKGROUND OF THE INVENTION

The invention relates to a compressed air servicing unit, comprising a plurality of modules, such as pressure controllers, filters oilers or the like, adapted to be attached together in any desired order and having module housings, one of such modules being designed in the form of a monitoring unit for the other modules and being electrically connected with same.

THE PRIOR ART

In the case of a compressed air servicing unit of this type as disclosed in the patent publication WO 96/38 671 the monitoring unit possesses plug connections on its lower side for plugs of transmission lines, which lead to the other modules in order to supply sensor signals of such modules to the monitoring unit. The disadvantage of this arrangement is that more particularly in the case of a large number of sequentially arranged modules there is a disorderly cluster of wires which will be even larger if the monitoring module is to control actuators in the modules in addition. Since each plug connection is associated with a given cable of one of the connected modules, any improper insertion of a plug will lead to improper function. If, as is provided for and possible, at a later date a different arrangement of the modules is to be selected, that is to say for instance to connect another module between existing modules, the lengths of the cables will no longer be correct and the cables must be replaced, shortened or extended. Lastly there is the further disadvantage that the maximum possible number of plug connections must be provided initially on the monitoring module, as otherwise expansion by the addition of further modules will not be possible. Since however only a smaller number of modules is selected, such an elaborate arrangement of plug connections is unnecessarily expensive and extravagant in space. Additional modules, which were not originally provided and for which no plug connection is present, may not be fitted, even in the case of a re-programming or modification of the circuit of the monitoring module.

SHORT SUMMARY OF THE INVENTION

One object of the invention is consequently to provide a compressed air servicing unit of the type initially mentioned, in the case of which the individual and order in relation to each other without adaptation of electrical connection lines being necessary and without wrong connections being produced.

In order to achieve these and/or other objects appearing from the present specification, claims and drawings, in the present invention a bus line, connecting the modules together, of a bus system is provided and furthermore the monitoring module performing control functions as well is provided with a central unit of the bus system and the other modules are provided respectively with a bus subscriber station, sensors and/or actuators present in or on a module respectively, being connected with the associated bus subscriber station.

In the case of the compressed air servicing unit of the invention it is possible for the individual modules to be placed initially in any desired, convenient sequential order and number. For the electrical together only the bus line of the bus system is employed, which excludes the possibility of incorrect connections, since all modules are connected together in the same fashion with one another. An adaptation of lines is not necessary either, since the bus line may be continued from one module to another, independently of the order of the modules. On connection of a further module the same is connected with the directly adjacent module. Direct connections with the monitoring module are not necessary in the bus system of the invention. For each extension of the system it is only necessary for a further piece of bus line to be added, all bus line pieces being identical. It is in this manner that a more rapid and absolutely reliable electrical connection is produced and between the modules, it being possible to maintain the bus line unchanged for a change in the order of the modules, merely a replugging being necessary. At the monitoring module only one bus line connection is required, independently of how many modules are connected. The number of modules may be increased as well without limitation, the connection of a new module, which was not previously provided, only involving a re-programming of the central unit if anything.

Further advantageous developments of the invention are defined in the claims.

It is an advantage if the central unit and/or the bus subscriber stations are arranged in separate housings and the same are able to be plugged, or so connected in some other way, to the housings of the modules that a sequential arrangement is produced. This means that practically the entire bus system may be plugged prior to or after mechanical assembly and the individual bus subscriber stations may be readily replaced by others. A further advantage is that the modules may be supplied in extremely simple designs even without a bus system, if the separate housings are omitted.

An advantageous design of the bus system is furthermore produced if the modules, including the monitoring module, are provided with electrical plug means for plug connection of the bus line, which accordingly connects together the bus subscriber stations of all modules and the central unit and is provided with corresponding mating plug means, the bus line being more particularly designed in the form of a bus line strand or bus line bar. It is preferred for the separate housings at least of the bus subscriber stations to be provided with such electrical plug means for plugging in the bus line. Accordingly it is also possible for the bus line to be fitted in place by plugging after mechanical assembly and for it to be partially or completely replaced at any time. Furthermore, in the case of a change in the mechanical order of the modules or in the case of expansion by the addition of further modules it is possible for the bus line to be returned to its functional state simply by replugging without any wrong connections being possible.

The separate housings are furthermore preferably provided with additional electrical plug means for the plug connections with actuators and/or sensors of the respective module. An even more flexible and simpler adaptation as regards changes in order and of expansion of the module arrangement is achieved, if the bus line in the form of a bus line bar consists of individual bar elements, of which each connects the plug means of two adjacent modules and each plug means is designed to receive two mating plug means of two sequentially arranged bar elements. If the modules possess the same width it is possible for all bar elements to be of identical design, expansion with a further module only involving the plugging in place of an additional bar element for expansion of the bus line. In this respect the bar elements are best toothingly engaged with each other in the plugged in position in order to achieve a mechanically and accordingly also electrically more stable arrangement.

In order to produce a more particularly flexible or adaptable system for arranging modules and the compressed air servicing unit the housings of at least the modules provided with bus subscriber stations provided on sides adjacent to opposite attachment sides are designed for attachment and/or receiving components necessary for the respective module function, and/or of covering elements. Accordingly in principle all modules may be based on the same module housing design, on which respectively such components are plugged or secured in some other way. Accordingly it is not only the electronic components, but also the mechanical or, respectively, pneumatic components which may be plugged or otherwise secured in a simple fashion to respectively identical module housings.

It is furthermore an advantage if the components necessary for the respective module functions are at least partly provided with electrical mating plug means, which are connected with actuators and/or sensors of this respective component, the fitting in position of this component on a module housing meaning that the mating plug means automatically produces a plug connection with the additional plug means of the separate housing arranged on the module housing. Accordingly no separate working and assembly operations for the separate connection of the actuators and sensors with the component subscriber stations are required.

Actuators, which are controlled by the central unit via the bus system, are for example valves and/or heating means or pressure or rate of flow controllers.

The monitoring module preferably possesses a connection means and a corresponding interface for the connection of the central unit with an external bus system. This means that the functions and activities of the compressed air servicing unit may be influenced from the outside, for example from a central computer. The same may hence assume additional monitoring functions in order for instance to monitor and/or control all compressed air servicing unit of a plant or of a building centrally.

In a first possible embodiment the monitoring module is provided with indicating and operating elements. As an alternative to this it is possible for the monitoring module, in a second preferred embodiment, to possess a diagnostic and operating interface for connection of a cable leading to a spatially remote indicating and operating device. This means that remote operation or remote diagnosis is able to be performed in an advantageous manner, more particularly because such compressed air servicing units are frequently arranged in inaccessible positions, in the case of which the reading of indicating elements and the actuation of operating elements is relatively difficult to perform.

In a particularly readily adaptable design of the monitoring module an enhancing element is provided on a plug attachment or assembly position of the monitoring module, such enhancing element being more particularly able to be plugged on or in and being fitted with the indicating and operating elements and/or being fitted with the diagnostic and operating interface. Differently designed enhancing elements or even covering elements can accordingly be arranged alternatively at the plug in or assembly point.

A serial bus system is more particularly suitable as a bus system.

Further advantageous developments and convenient forms of the invention will be understood from the following detailed descriptive disclosure of embodiments thereof in conjunction with the accompanying drawings.

LIST OF THE SEVERAL VIEWS OF THE FIGURES

DETAILED ACCOUNT OF WORKING EMBODIMENTS OF THE INVENTION

Figure 1:
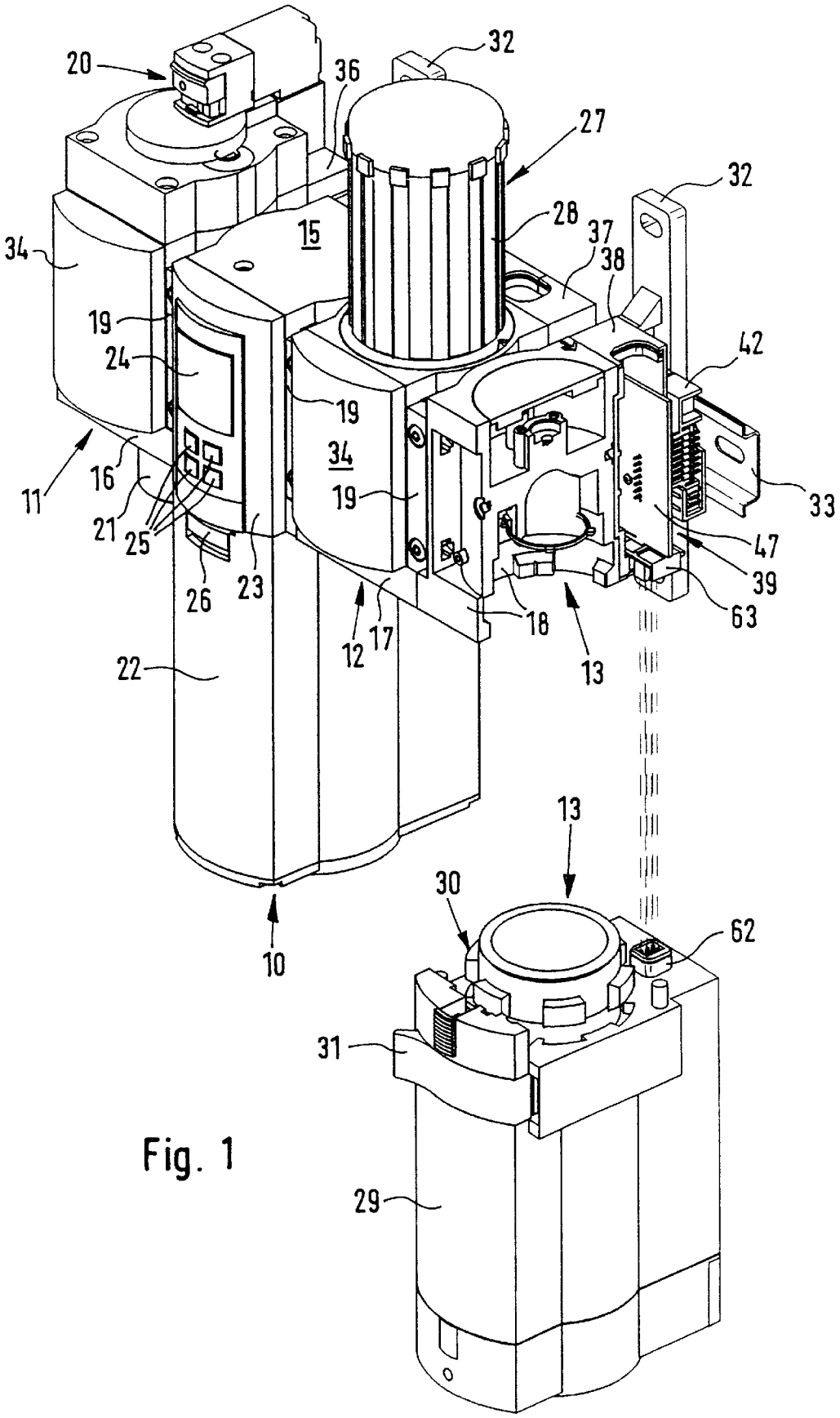
FIG. 1 shows a perspective elevation of a compressed air servicing unit as an embodiment of the invention, which comprises four modules including a monitoring module.
Figure 2:
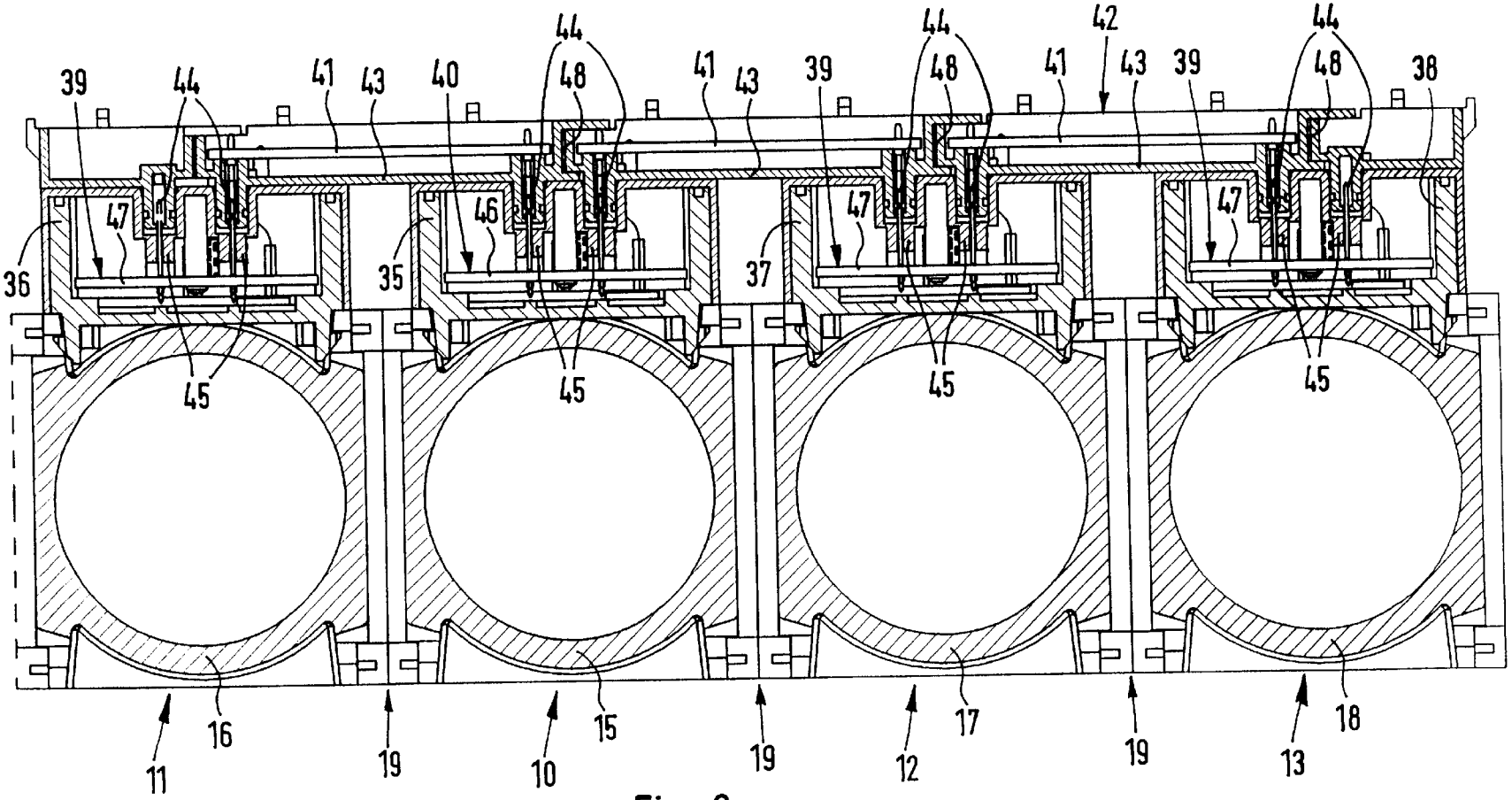
FIG. 2 is a cross sectional view of four sequentially arranged module housings of the compressed air servicing unit represented in FIG. 1, bus subscriber stations arranged in respective separate housings being plugged in position and connected by a bus conducting bar.

In the case of the embodiment of the invention, represented in FIGS. 1 and 2, in the form of a compressed air servicing unit a monitoring module 10 is connected with three further modules 11 through 13 in a sequential arrangement. The module 11 is designed in the form of a switching valve module and possesses a switching valve 20 in order to be able to permit the passage of compressed air supplied from the inlet or to shut off such air. The module 12 is designed as a pressure controlling module in order to be able to be set any desired pressure as required in particular circumstances. The partially sectioned module 13, which is cut into two parts, is designed in the form of a filter module.

The four modules 10 through 13 may also be connected together in a different sequential arrangement, further modules with known functions being fitted, such as a soft start module for controlled build up of pressure, an oiler module for controlled supply of oil or a flow rate measuring module for measuring the rate of air flow through the equipment. For instance it is also possible to implement a plurality of functions in single module, as for example the function of a combined pressure controller and filter module.

The modules 10 through 13 essentially comprise a standard module housing 15 through 18, which is open at the bottom and at the top, as may be seen from the sectioned module housing 18 for example. The respectively adjacent module housings 15 through 18 are engaged fitted together at one respective side and are connected together by attachment means 19, same only being diagrammatically indicated. Such attachment means 19 may for example be dovetail slot systems with fastening or screw elements, screw connections, detent connections, clamping connections or connections in accordance with the initially mentioned prior art. An air channel, not illustrated, extends transversely through the module housings 15 and 18, which are connected together, in such a manner that the air current is supplied past or through the means which are plugged or otherwise connected with the opposite openings of the module housings 15 through 18. For this purpose the module housings 15 through 18 possess connecting openings, not illustrated, arranged on the opposite attachment sides, such openings being able to be connected together in a sealing fashion on fitting the module housings 15 through 18 together.

At the top opening of the module housing 16 of the switching valve module 11*a* switching valve 20 is arranged in order to be able to interrupt the flow of air therethrough. The bottom opening is shut off by a cover 21. In the case of the monitoring module 10 there is a bottom housing 22 for electronic components, whereas the top side of the corresponding module housing 15 is shut off. It may be shut off by having a closed module housing 15, which differs from the remaining module housings 16 through 18 in this respect, or by having a cover. On the front side of the module housing 15 an indicating and operating board 23, which possesses a display 24 and operating elements 25, is plugged or detent-locked in position. Such indicating and operating plate 23 may be unlocked and removed by operation of a release element 26. This will be explained in more detail with reference to FIG. 4 later.

In the case of the module 12 designed in the form of a pressure controller module, the housing 17 is closed at the bottom, whereas at the top an adjustable pressure controlling unit 27 is inserted. The latter possesses a rotary button 28 for setting the desired pressure. Such pressure may be controlled or regulated as an alternative or in addition by the monitoring module 10.

In the case of the module 13 designed in the form of a filter module the top opening of the module's housing 18 is shut off by a cover, not illustrated, whereas a filter unit 29 is inserted from below for filtering the air flowing through the equipment. In the illustrated working embodiment such filter unit 29 possesses a bayonet fastener 30, which may be released by means of a release lever 31 again, although other known fastening means may be employed for this purpose. For wall attachment of the compressed air servicing unit use is made of two holding means 32 adapted to be fixed to a wall and which are connected with the compressed air servicing unit in a manner not illustrated in detail, for example by screws or a catch. These holding means 32 also bear a horizontally arranged holding rail 33.

The front sides of the module housings 16 through 18 bear cover baffles 34, whose configuration is adapted to that of the indicating and operating board 23. On the rear sides of the module housings 15 through 18, see more particularly FIG. 2, additional housings 35 through 38 are pluggedly attached or held by detent catches. The additional housings 36 through 38 respectively comprise bus subscriber stations of a bus system, which is designed in the form of a serial bus. In principle a parallel bus system would also be possible. The additional housing 35 plugged to the monitoring module 10 comprises a central unit 40 of the bus system. The bus subscriber stations 39 and the central unit 40 are connected with each other with the aid of a bus line bar 42 containing a multiple core bus line 41. The bus line bar 42 comprises individual bar elements 43, which respectively at their ends have mating plug means 44, which are designed for plugging into corresponding plug means 45 of the additional housings 35 through 38. For the sake of simplification in FIG. 2 only the corresponding boards 46 and 47, without the electronic components mounted thereon of central unit 40 and the bus subscriber stations 39 are illustrated. Two respective plug means 45 are so arranged on the boards 46 and 47 that two contiguous bar elements 23 may be plugged in place. These two plug means 45 are connected with one another by means of a bus line on the boards 46 and 47 so that the bus line as a whole is prolonged on plugging in a further bar element 43. In the plugged state the bar elements 43 are connected with each other by tooth means 48.

Departing from the illustrated embodiment of the invention it would be possible for the mounted housing 35 to be designed integrally with the module housing 15. Furthermore, in an alternative design the central unit 40 could be accommodated in the housing 22 as well, the board 46 only being designed for electrical signal transmission. The bar elements 43 and, respectively, the bus line bar 42 is plugged to the holding rail 33 or attached thereto by a detent. For this purpose detent spurs 49 are employed. In a simpler design it is naturally also possible to do without the detent spurs 49 and the holding spurs 33.

Figure 3:
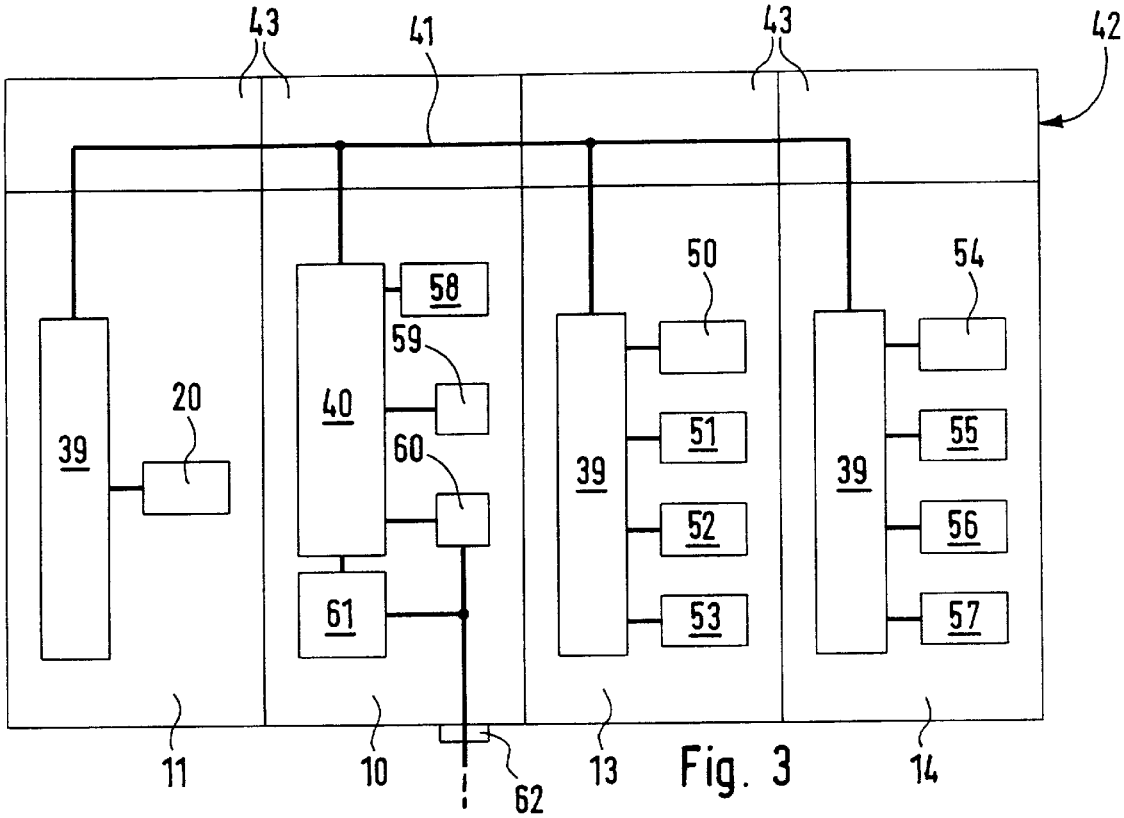
FIG. 3 is a diagrammatic block view of a compressed air servicing unit comprising four modules.

The block circuit diagram of FIG. 3 diagrammatically shows the electrical connection between the bus subscriber stations 39 and the central unit 40 via the bus line 41 and, respectively, the bar elements 43 of the bus system bar 42. In the module 11 as an actuator the switching valve 20 is connected with the bus subscriber station 39. This means that this switching valve 20 may be operated from the central unit 40.

A condensate level sensor 50, a condensate drain valve 51, a temperature sensor 52 and a heating means 53 are connected with the bus subscriber station 39 in the module 13 designed in the form of a filter module. This means that the condensate level may be automatically detected in the central unit 40 and the condensate drain valve 51 can be automatically operated, when the maximum permissible level has been exceeded. The temperature in the module 12 can be detected and controlled, respectively using the temperature sensor 52 and the heating means 53.

This module 13 designed in the form of a filter module can also designed in the form of a combined filter control module, that is to say such module constitutes a combination of the modules 12 and 13 as in FIGS. 1 and 2, the filter unit 29 being arranged on the bottom of the corresponding module housing and the pressure regulator unit 27 being mounted at the top.

As a further module 14, which has not so far been described, an oiler module is connected. An oil level sensor 54, an oil topping up valve 55, a temperature sensor 56 and a heating means 57 are connected with the bus subscriber station 39 of this module 14. In this case the central unit 40 is employed for monitoring the oil level and when required the oil topping up valve 55 is opened for topping up oil. The temperature sensor 56 and the heating means 57 render possible the detection of the temperature and the regulation thereof.

A pressure sensor 58, a diagnostics interface 59, an interface 60 in the form of a CP/CAN interface and a power supply 61 are connected with the central unit 40 in the monitoring module 10. By way of an external connection 62 the power supply 61 is supplied with a supply voltage and simultaneously the interface 60 is connected with an external bus system, if such a bus system is present and a connection is desired with the central unit 40. The power supply for the electronic and electrical means in the modules 11 through 14 is with the aid of power lines, not illustrated, which run in parallelism to the bus line 41, the connections with the bus line being produced in a suitable manner using the bus line bar 42. The diagnostics interface 59 will be described in more detail with reference to FIG. 4. The pressure sensor 58 serves for detecting the pressure, such pressure sensor 58 being able to be arranged in the pressure controller module or in a combined filter and controller module.

The connection between the actuators and the sensors and optionally the interfaces as well is FIG. 1 such that the enhancement elements (such as the switching valve 20 or the filter unit 29) are provided with electrical mating plug means 62 on the module housings 15 through 18, which means 62 are plugged in the plug means 63 of the additional housings 35 through 38 on plugging in or attaching on the respective module housings 15 through 18 so that an electrical connection is produced automatically between the actuators and the sensors on the one hand and between the associated bus subscriber station 39 on the other hand. For this purpose the boards 47 are provided at the top and bottom with such plug means 63, it being possible in a simpler design for only one such plug means to be provided. The same applies for the monitoring module 10 as well, in which case the housing 22 is provided with such a mating means 62 (not illustrated), which is electrically connected, on plugging the module housing 15 in position, with a plug means 63 of the additional housing 35 electrically, independently of whether the additional housing 35 is connected integrally with the module housing 15 or is manufactured as a separate housing. The electrical connection of the indicating and operating board 23 with the monitoring module 10 may be in the same manner.

It is naturally possible for the additional housings 36 through 38 to be integrally connected with the associated module housings 16 through 18.

Figure 4:
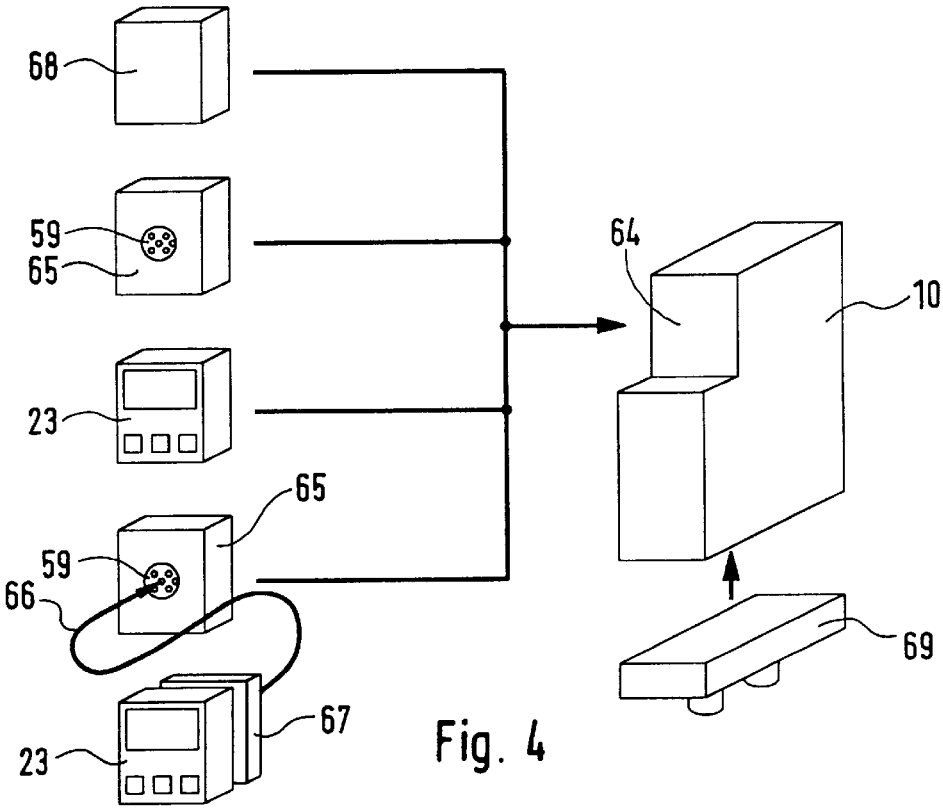
FIG. 4 shows a monitoring module adapted to be connected with different enhancing elements.

In FIG. 4 the monitoring module 10 and the indicating and operating board 23 are illustrated diagrammatically. As described already this indicating and operating board 23, which may be in the form of a box if desired as well, may be plugged on at a suitable plug point 64 or, respectively, in a corresponding plug recess, or as in FIG. 1 detachably snapped in place as indicated. Accordingly the electrical connections with the central unit 40 will be produced simultaneously. On the display 24 it is possible for the parameters measured in the modules to be indicated and monitored. This may be performed automatically or by means of the operating elements 25. With the aid of such operating elements 25 it is possible for limiting data to be changed and/or for control commands for the actuators to be input directly. Furthermore it is in principle also possible for re-programming of the central unit to be performed.

Instead of the indicating and operating board 23 it is also possible for a plug element 65 having the diagnostics interface 59 thereon to be mounted. Same can be connected via line 66 with a remote plug means 67, on which the indicating and operating board may be plugged. It is in this manner that it is possible for monitoring and operation of the compressed air servicing unit to be performed from some remote point in which case the compressed air servicing unit will no longer have any indicating and operating means itself. Instead of the plug means 67 and the indicating and operating board 23 it is naturally also possible to have a differently designed indicating and operating unit at the point remote from the compressed air servicing unit.

If no indicating and operating steps are necessary, the plug point 64 may be filled up or covered over by a suitably shaped baffle 68.

The interface 60 may also be arranged in a plug means 69, which in accordance with the bottom part of FIG. 4 is designed on the monitoring module 10 in a pluggable manner. It is naturally possible for it to be arranged at other positions if required.

What is claimed is:

1. A compressed air servicing unit comprising:

a bus system including a bus line bar having a plurality of individual bus elements electrically connectable to each other to form a bus line;

a plurality of air service modules being selectively attachable together, each of the plurality of air service modules including a housing and a bus subscriber station, and the plurality of air service modules being secured to the bus line bar and electrically connected to the bus line; and a monitoring module for monitoring the air service modules and being electrically connected to each of the plurality of air service modules, the monitoring module including a central unit of the bus system, and the bus system electronically connecting the monitoring module and the bus subscriber stations of the air service modules together.

2. The compressed air servicing unit as set forth in claim 1, wherein the central unit is arranged in a central unit housing that is separate from and connectable to the monitoring housing and the bus subscriber stations are arranged in bus subscriber housings that are separate from and connectable to the air service module housings.

3. The compressed air servicing unit as set forth in claim 2, wherein the air service modules and the monitoring module, are provided with electrical plug means for plug connection to the bus line, which accordingly connects together each of the bus subscriber stations and the central unit.

4. The compressed air servicing unit as set forth in claim 3, wherein the the bus subscriber housings each include electrical plug means for plugging into the bus line.

5. The compressed air servicing unit as set forth in claim 4, wherein the bus subscriber housings are furthermore provided with additional electrical plug means for the plug connections with actuators and/or sensors of the respective module.

6. The compressed air servicing unit as set forth in claim 5, wherein the air service modules housings are adapted to attachably receive components necessary for a respective air service module function and wherein the components necessary for the respective air service module functions are provided with electrical making plug means, which are connected with actuators and/or sensors of this respective component.

7. The compressed air servicing unit as set forth in claim 3, wherein the individual bar elements of the bus line bar connects the plug means of two adjacent air service modules and each plug means is designed to receive two mating plug means of two sequentially arranged bar element.

8. The compressed air servicing unit as set forth in claim 7, wherein the bar elements are toothedly connected together in the plugged in state.

9. The compressed air servicing unit as set forth in claim 1, wherein the air service modules housings are adapted to attachably receive components necessary for a respective air service module function.

10. The compressed air servicing unit as set forth in claim 1 wherein one of the air service modules includes an actuator selected from the group consisting of a valve a heating means pressure controller and a flow rate controller.

11. The compressed air servicing unit as set forth in claim 1, wherein the monitoring module comprises a connection device and a corresponding interface for the connection to the bus system.

12. The compressed air servicing unit as set forth in claim 1, wherein the monitoring module is provided with indicating and operating elements.

13. The compressed air servicing unit as set forth in claim 1, wherein the monitoring module includes a diagnostic and operating interface for connection of a cable leading to a remote indicating and operating device.

14. The compressed air servicing unit as set forth in claim 13, comprising an enhancing element mounted on a plug attachment of the monitoring module, the enhancing element being able to be plugged in and being fitted with either of the indicating and operating elements and the diagnostic and operating interface.

15. The compressed air servicing unit as set forth in claim 1, wherein the bus system is a serial bus system.

16. A compressed air servicing unit comprising:

a bus system including a bus line bar having a bus line;

a plurality of air service modules being selectively attachable together, each of the plurality of air service modules including a housing and a bus subscriber station, and the plurality of air service modules being secured to the bus line bar and electrically connected to the bus line; and a monitoring module for monitoring the air service modules and being electrically connected to each of the plurality of air service modules, the monitoring module including a central unit of the bus system, and the bus system electronically connecting the monitoring module and the bus subscriber stations of the air service modules together.

* * * * *